United States Patent [19]

Garrido et al.

[11] Patent Number: 5,060,763

[45] Date of Patent: Oct. 29, 1991

[54] SIMPLIFIED AUTOMATIC TELESCOPIC DOORS FOR ELEVATORS

[75] Inventors: Alfonso Garrido; Juan Martin; Jose Sevilleja, all of Madrid, Spain

[73] Assignee: Otis Elevator Company, Farmington, Conn.

[21] Appl. No.: 555,886

[22] Filed: Jul. 23, 1990

[51] Int. Cl.[5] ..... B66B 13/00

[52] U.S. Cl. ..... 187/51; 187/56; 49/120

[58] Field of Search ..... 187/51, 56, 52, 58, 187/1 R; 49/120, 116, 453; 160/196.1, 197

[56] References Cited

U.S. PATENT DOCUMENTS

| | | | |
|---|---|---|---|
| 1,966,182 | 7/1934 | McCormick | 187/52 R |
| 4,177,881 | 12/1979 | Kappenhagen | 187/56 |
| 4,357,993 | 11/1982 | Halpern et al. | 187/1 R |

FOREIGN PATENT DOCUMENTS

| | | | |
|---|---|---|---|
| 2802618 | 7/1979 | Fed. Rep. of Germany | 187/1 R |
| 62845 | 5/1977 | Japan | 187/51 |
| 116648 | 10/1978 | Japan | 187/1 R |

*Primary Examiner*—Robert P. Olszewski
*Assistant Examiner*—Kenneth Noland
*Attorney, Agent, or Firm*—William W. Jones

[57] ABSTRACT

The improvments are applicable to elevator doors and even to doors of vehicles, either made out of two leaves which move in the same direction for the opening and closing thereof, or made out of four leaves each pair of the four leaves opening in the center. The improvements are centered on the use of a single track for both leaves or door panels, a track which may have a rectangular or circular section, located in a box with rolling or movement components which are fastened to the corresponding hanger support of the panel or door. Another improvement consists of the two panels of the door being exactly the same, each one of them including a sound absorbing element. The door frame unit is removable with preassembled active elements so that the same may be transported in a compact, easy manner from the factory to the place of use.

6 Claims, 2 Drawing Sheets

SIMPLIFIED AUTOMATIC TELESCOPIC DOORS FOR ELEVATORS

TECHNICAL FIELD

As is expressed in the title of this specification, the present invention refers to a series of improvements introduced in automatic telescopic doors which are used for elevators, without ruling out the use of these doors for vehicles.

The improvements are centered on the guide or track system for the panels of the doors themselves, as well as on rolling means and on the shape itself of the profiles of said doors, also including soundproofing means.

BACKGROUND ART

Conventional telescopic doors for elevators are basically composed of a metallic frame where a series of main subassemblies are assembled:

Two parallel tracks;

A door panel hanger support equipped with rollers and counter-rollers; and

More or less complex door profiles or panels for fire labyrinth needs.

Most of the conventional solutions in this type of door use two tracks and even at times a solid double track form on which the respective displacement roller and counter-roller form a complete unit. Thus adjustment thereof is difficult to attain because a large number of pieces have to be put in place and adjusted. Likewise, the structural lintel of the door unit has to be effected in such a way that it provides two or three different flat references in order to fasten the two tracks with the corresponding separators and screws.

This type of configuration likewise gives rise to problems of parallelism and straightness of the two tracks plus the cited lintel.

On the other hand, the functioning is likewise negatively affected by the cantilevered configuration of the roller and counter-roller that require very strong shafts and hanger supports to overcome the deformation produced by overhanging doors during reopening.

It should also be taken into account that in conventional doors the panel always has the tendency to be noisy and resonant during movement of the door and in most cases a welded sandwich configuration is necessary to overcome resonance, and sometimes special noise absorbing paint or materials have to be added.

Consequently, depending on the structures of doors for conventional elevators, the main problems reside in cost and quality due to the large number of separate elements, as well as the precision required to obtain parallel smooth movement of the telescopic elements and to the noise produced during operation thereof.

Normally, if the product has to be competitive from the cost point of view, the elements are too weak, giving rise to problems of noise, jerks and wear and tear of the panel surfaces, with regard to the horizontal scratches produced by undesired contacts between moveable parts.

Finally, it should be said that the assembly of this type of door requires a long time to effect the assembly and adjustment of the different elements, which increases the cost and what is more important the cost of maintenance.

DISCLOSURE OF THE INVENTION

The improvements that the invention proposes are applicable to the type of above-cited automatic telescopic doors for elevators wherein the features of novelty or improvements themselves are centered on the following four basic points:

1. Use of a single track for both high-speed and low-speed door panels.
2. Use of a very simple rolling package with a very stiff construction avoiding the need of any adjustment.
3. Soundproof and fireproof door panel composed of a single steel sheet profile to which a sound absorbing device is added.
4. Dismountable frame with active elements preassembled for a compact and easy transport from factory to the field with minimum manufacturing and erection time.

Therefore, one of the features which are claimed as novel is that the automatic elevator door that the invention proposes has a single sliding track common to both door leaves.

Likewise, the rolling means of each door consist of units independent from the track, fixed to the corresponding door hanger support.

On the other hand, the door profiles are identical to each other and are provided with suitable orthogonal foldings in their longitudinal edges to determine a fire labyrinth configuration as well as sealing between both profiles or doors.

Another particular feature is that the general assembly frame of said doors comprises suitable profiles assembled together. They can be dismounted which makes it possible to effect the assembly in situ.

In order to complete the description which is going to be made hereinafter and for the purpose of providing a better understanding of the features of the invention, the present specification is accompanied by a set of drawings on the basis of whose figures the scope of the invention will be more easily understood.

BEST MODE FOR CARRYING OUT THE INVENTION

Figure 1:
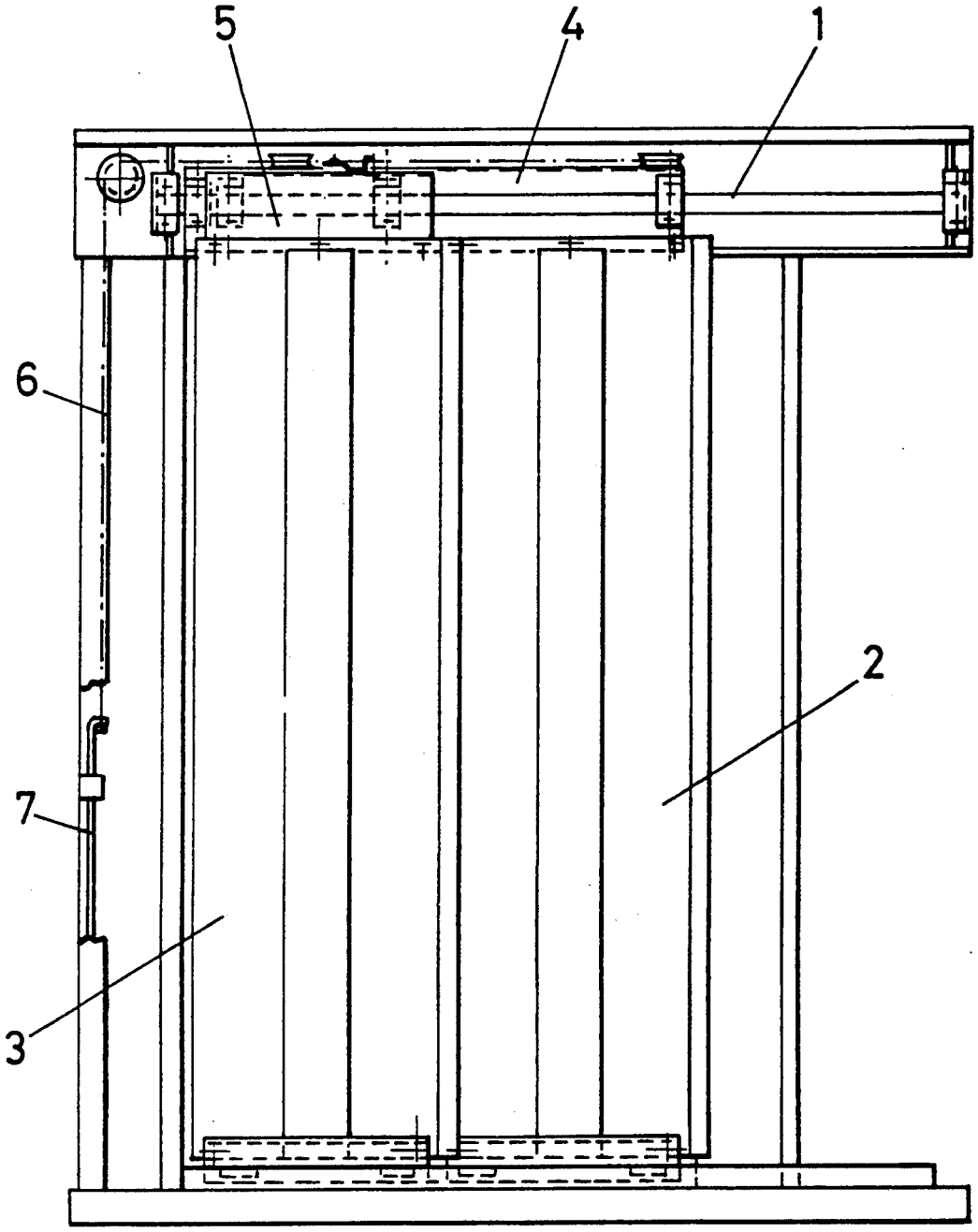
FIG. 1 shows a front view of an automatic two-leaf telescopic door for elevators.

In view of these figures, one can see how the improvements of the invention are applicable to the type of automatic telescopic doors for elevators which include a single sliding track (1) for high-speed door panels (2) as well as for low-speed door panels (3). It is provided that the corresponding hanger support 4 of the door 3 is longer than the hanger support of the door 2, thus allowing a center part of the track 1 to be left free for the purpose of installing the hanger support 5 of the high-speed door 2. In FIG. 1 one can see the hauling cable 6 passing through the corresponding pulley-wheels and connected to a counterweight 7, as usual.

Figure 2:
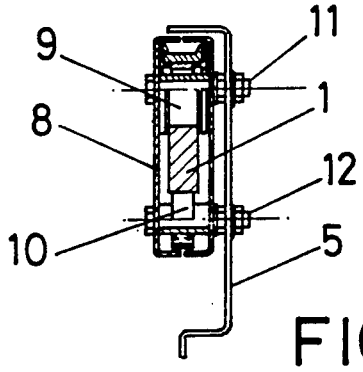
FIG. 2 shows a sectional view of the rolling package of the doors of the invention.
Figure 3:
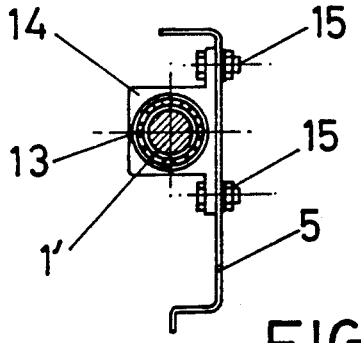
FIG. 3 shows an alternative or variant of the embodiment of the rolling package.

Logically, the supports 4 and 5 will move along the single track 1 based on a rolling system like the one shown in FIGS. 2 and 3.

In FIG. 2 one can see how the guide or sliding track 1 has a rectangular section and the same is fastened to the general structural frame by friction and without the need of machining or additional operations of welding perforations, thus avoiding the conventional problem of alignment of the two parallel tracks which are used in conventional doors, as well as separators, screws, welding, etc.

The rolling element or system shown in FIG. 2 is made up of a box 8 which contains and protects all the rolling elements, thus avoiding the cantilever roller and counter-roller configurations which are used in the conventional designs and which have an inherent flimsiness.

This rolling package has a single piece independent from the track 1 and includes all the elements for the fastening thereof to the hanger support 5 of the door panel for the purpose of producing side movement without any adjustment and with automatic attainment of the desired clearance for movement.

Rollers 9 and 10 which rest precisely on the top and bottom edges of the track 1 are mounted inside the box 8. These rollers are fastened by through screws 11 and 12, respectively, which aside from serving as a support for the rollers are means for fastening the unit, in other words, the box 8 with all its elements to the respective hanger support 5 of the door.

The rigidity of this described configuration is essential to obtain smooth movement of the door panels without jerks and resistance when reopening the doors, in the event that they encounter obstacles during closing.

A variant of the embodiment of the rolling system is shown in FIG. 3, where one observes that the track consists of a bar 1', using some linear ball bearings 13 as a roller means and which are provided in the corresponding box 1, fastened to the hanger support 5 of the door by screws 15.

Both rolling or sliding systems allow a substantial reduction of assembly and a total elimination of the adjustment time, given that the track unit, rolling package and hanger supports of the doors can be manufactured and installed in the buck lintels so that the same can be assembled and easily transported to the field.

Figure 4:
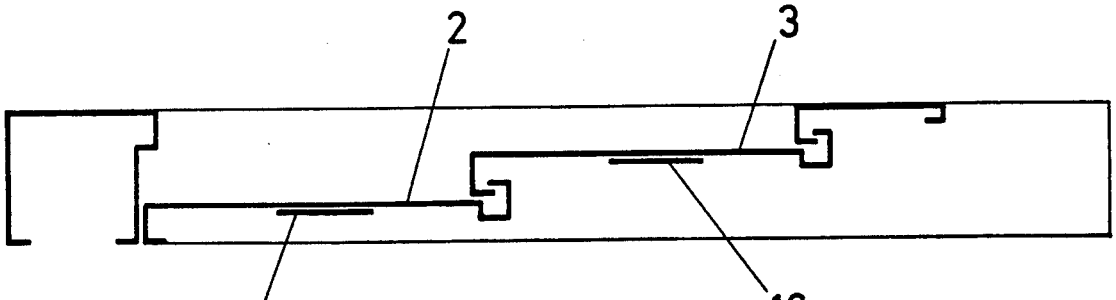
FIG. 4 shows a schematic view of a cross-section of the two profiles corresponding to the two doors represented in FIG. 1, which include a soundproofing element. One can see how the two door profiles are identical to each other even when they are connected to different hanger supports.

Finally FIG. 4 shows a schematic cross-section of the two doors 2 and 3 formed by sheet panels with an identical profile in both cases and with six orthogonal foldings as is shown in FIG. 4. They form sealing means and fire labyrinth paths.

In FIG. 4 one clearly sees how it is possible to obtain the moment of inertia desired in both edges of the panel 2 or 3, in such a way that only six orthogonal foldings or curves obtain the rigidity and fire protection labyrinth.

Each panel or profile of the doors 2 and 3 include a soundproofing element whose simplicity permits, nevertheless, obtainment of a very good capacity of noise absorption of the corresponding door panel, that element consisting of a narrow metal panel 16 which is totally flat and very thin and fastened centrally and longitudinally in each panel 2 being a noise absorption resonant element. The fastening is done with glue and the position thereof is maintained in the top and bottom parts by screws which are used in turn to fasten the door panel to the hanger supports, as well as to the lower guide-shoe metallic support.

On the other hand, it should be said that the door unit includes a frame easy to assemble and disassemble and it is easily transported to the field and there is even a high degree of pre-assembly at the factory, all of which permits a considerable reduction of installation and assembly time.

Although throughout the present description the improvements have been referred to telescopic doors for elevators which include two panels, they are also applicable to two-speed four panel doors opening in the center, which basically consists of reproducing the described door system with a symmetric door, coupling both systems to obtain double free opening.

Likewise, the improvements are applicable to doors of vehicles and doors opening in the center in which the described elements also make it possible to obtain most of said advantages.

What is claimed is:

1. An automatic telescopic door assembly for elevators and the like, comprising two door panels displaceable laterally and telescopically, one of a high speed and the other of a low speed and which door panels move in the same first direction to open, and move in the said opposite direction to close, said door panels hanging from the respective supports to which sliding rolling means are fastened; a single sliding tract common to both door panels and carrying said rolling means for each door panel; the rolling means of each door consisting of units independent from the track and fastened to the corresponding hanger support of the door; said door panels being identical to each other in profile and provided with suitable orthogonal foldings in their longitudinal edges to form a fire labyrinth configuration and sealing both door panels together.

2. The automatic telescopic door assembly, according to claim 1, wherein the sliding track for the rolling packages consists of a rectangular cross-section horizontal bar.

3. The automatic telescopic door assembly, according to claim 1, wherein the sliding track for the rolling packages consists of a circular-section bar complemented by linear ball bearings.

4. The automatic telescopic door assembly of claim 1, wherein the fastening means of the different elements forming the rolling means over the corresponding sliding track are the same fastening means of each rolling means to the respective hanger support of the door.

5. The automatic telescopic door assembly of claim 1, wherein the hanger support of the low-speed door is longer than the hanger support of the high-speed door.

6. The automatic telescopic door assembly of claim 1, wherein a fine metallic sheet, preferably of steel is attached and fastened centrally and longitudinally to an outside surface of each door providing a soundproofing means of the respective door.

* * * * *

UNITED STATES PATENT AND TRADEMARK OFFICE

CERTIFICATE OF CORRECTION

PATENT NO. : 5,060,763

DATED : October 29, 1991

INVENTOR(S) : Alfonso Garrido, et al.

It is certified that error appears in the above-identified patent and that said Letters Patent is hereby corrected as shown below:

In Column 4, line 32, please delete the word "tract" and insert the word --track-- in lieu thereof.

Signed and Sealed this

Second Day of February, 1993

*Attest:*

STEPHEN G. KUNIN

*Attesting Officer*

*Acting Commissioner of Patents and Trademarks*